United States Patent [19]

Mori et al.

[11] Patent Number: 4,780,154

[45] Date of Patent: Oct. 25, 1988

[54] SHAPE MEMORY ALLOY AND METHOD FOR PRODUCING SAME

[75] Inventors: Tsutomu Mori, Suginami; Akikazu Sato, Yokohama; Hiroo Suzuki, Kawasaki; Yasushi Nakamura, Kawasaki; Masato Murakami, Kawasaki, all of Japan

[73] Assignee: Nippon Steel Corporation, Chiyoda, Japan

[21] Appl. No.: 24,855

[22] Filed: Mar. 17, 1987

Related U.S. Application Data

[63] Continuation of Ser. No. 772,761, Sep. 5, 1985, abandoned.

[30] Foreign Application Priority Data

| | | | |
|---|---|---|---|
| Sep. 7, 1984 | [JP] | Japan | 59-187403 |
| Jan. 3, 1985 | [JP] | Japan | 60-40559 |
| Jan. 3, 1985 | [JP] | Japan | 60-40560 |
| Jan. 3, 1985 | [JP] | Japan | 60-40561 |

[51] Int. Cl.[4] ..... C21D 8/00; C22C 38/04

[52] U.S. Cl. ..... 148/12.1; 148/12 R; 148/402; 148/329

[58] Field of Search ..... 148/402, 329, 12 R, 148/12.1, 442; 420/72–74, 581–585; 428/960

[56] References Cited

U.S. PATENT DOCUMENTS

| | | | |
|---|---|---|---|
| 3,989,551 | 11/1976 | Brook et al. | 148/11.5 R |
| 3,989,552 | 11/1976 | Brook et al. | 148/11.5 R |

FOREIGN PATENT DOCUMENTS

| | | | |
|---|---|---|---|
| 666628 | 10/1938 | Fed. Rep. of Germany . | |
| 55-73846 | 6/1980 | Japan . | |
| 55-76043 | 6/1980 | Japan . | |
| 57-185958 | 11/1982 | Japan | 420/72 |
| 60-43472 | 3/1985 | Japan . | |
| 0638622 | 12/1978 | U.S.S.R. | 148/12.1 |

OTHER PUBLICATIONS

Chemical Abstracts, vol. 100, No. 26, Jun. 25, 1984, p. 237, NO. 213858f, Columbus, Ohio, U.S.; A. Sato et al.: "Orientation and Composition Dependencies of Shape Memory Effect in Iron–Manganese–Silicon Alloys" & Acta Metall. 1984, 32(4), 539–47.

"Summary of General Lecture in Autumn Congress of Japan Institute for Metal", Oct. 1984, p. 550, No. 692.

Acta Metallurgica, "Orientation and Composition Dependencies of Shape Memory Effect in Fe–Mn–Si Alloys", vol. 32, No. 4, pp. 539–545 (1984), A. Sato et al.

*Primary Examiner*—Deborah Yee

[57] ABSTRACT

A known Ti-Ni based and Cu-based shape memory alloy can be replaced by an Fe-based shape memory alloy. An excellent shape memory effect is attained by an Fe-based shape memory alloy with an Mn content of 20% to 40% and an Si content of 3.5% to 8%.

26 Claims, 3 Drawing Sheets

$M_s^{\gamma\to\varepsilon}$ POINT

SHAPE MEMORY ALLOY AND METHOD FOR PRODUCING SAME

This application is a continuation, of application Ser. No. 772,761, filed Sept. 5, 1985, abandoned.

BACKGROUND OF THE INVENTION

1. Field of the Invention

The present invention relates to a shape memory alloy which contains Fe, Mn, and Si as basic elements and to a method for producing the same. The shape memory alloy memorizes the shape before plastic working, the strain of which working rs imparted at a Md point or lower temperature. The memory effect appears upon heatrng to an As point or higher.

2. Description of the Related Art

A number of alloys having shape memory properties, from Ti-Ni alloy and Cu-based alloy to Fe-based alloy, have been disclosed (c.f., for example, "Kinzoku", February 1983, page 12). The shape memory effect is a phenomenon accompanying martensitic transformations. Therefore, such alloys respond at a high speed to external force. Further, the identical phenomenon can be utilized repeatedly. Repeated utilization of the shape memory effect is convenient in practical application of the alloys.

The first utilization of a shape memory alloy was for a joint of hydraulrc piping of an airplane. Recently, it has been utilized in broader fields, such as home appliances, industrial robots, engines, and medical devices. For these applications, the shape memory alloy is required to have a particular range of transformation temperatures, the martensite-transformation starting temperature Ms, the austenite-transformation starting temperature As, and the like, hardenability, easy manufacture, workability, and corrosion resistance. For structural uses, the shape memory alloy must have excellent strength, toughness, corrosion-resistance and economicalness Ti-Ni alloy is exceedingly superior to other alloys in all of these properties, except for easy manufacture and economicalness and has already been put into practical uses. Nevertheless, Ti-Ni alloy has the disadvantage that strict control must be maintained over the ranges of composition of the Tr and Ni, thus preventing mass production. Further, both Ti and Ni are expensive. This limits its usefulness.

Attempts have been made to develop Cu-based shape memory alloys, which are inexpensive. These copper-based alloys, however, are susceptible to intergranular fractures, and suffer from low tensile strength, compression strength, and fatigue strength.

Provisions of an iron-based shape memory alloy with respectively inexpensive alloying elements not only would lead to outstanding advantages, such as the easy manufacture and economicalness, but also would enable improved strength and toughness. These improved properties offered by an Fe-based alloy would enable such structural uses as the fastening parts of a bolt and nut, pipe joints, and functional uses comparable to those of Ti-Ni alloy. It could thus be used in broader fields than Ti-Ni alloy.

Several of Fe-Ni alloys and Fe-Mn alloys displaying the shape memory effect have been reported up to now, but their shape memory ettects cannot be said to be complete. Also they suffer from drawbacks in the range of transformation temperatures and productivity.

Japanese Unexamined Patent Publication (Kokai) No. 53-11861 recites an example of the Fe-Mn alloys. According to this publication, the shape memory characteristic is not appreciable at a Mn content exceeding 30%, allegedly because the magnetic transformation point ($\theta_N$ Neel point) is raised due to a high Mn content and, hence, the $\gamma$ (face centered cubic structure-austenite)—$\epsilon$ (closest packing hexagonal structure-martensite) transformation at ambient temperature is suppressed.

SUMMARY OF THE INVENTION

The present invention proposes to add Si into an Fe-based shape memory alloy containing manganese and having the merits as described above, thereby lowering the Neel point and facilitating the $\gamma$-$\epsilon$ transformation so as to sufficiently improve the shape memory efteot. The present invention is characterized in that the Fe-Mn shape memory alloy consists of, by weight percentage, from 20% to 40% of Mn and from 3.5% to 8% of Si, the balance being Fe and unavoidable impurities.

The present inventors prepared single crystals of Fe-Mn-Si alloys, such as Fe-30% Mn-1% Si, and Fe-27% Mn-3% Si, and affirmed that they had virtually 100% of the shape memory effect in a particular tensile direction. That is, the shape memory effect of single crystalline Fe-Mn-Si alloys is sharply dependent upon the tensile direction and decreases to 20% or less upon variation in the tensile direction. The shape memory effect herein quantitatively speaking is expressed by (the restored quantity of strain by heating/the quantity of strain imparted at room temperature)$\times$100%. The above single crystals are not only difficult to produce but also must be used in a narrow scope of utilization. Incidentally, the alloy according to the present invention is polycrystalline.

The shape memory effect of the Fe-based shape memory alloy, the shape memory effect obtained by means of the $\gamma \rightleftarrows \epsilon$ transformation, appears to become incomplete due to the fact that, in the martensitic structure induced by the plastic working, not only is the $\epsilon$ phase present, but also the $\alpha'$ phase is mixed in. Further, slip deformation, other than the $\gamma$-$\epsilon$ transformation, i.e., any permanent deformation, is induced. It is therefore necessary to suppress the $\alpha'$ martensite and, preferentially induce the $\gamma$-$\epsilon$ transformation. Fe-Mn alloy, in which $\alpha'$ martensite is not introduced by plastic working is preferred over Fe-Ni alloy, in which the $\alpha'$ martensite is.

DESCRIPTION OF THE PREFERRED EMBODIMENTS

Figure 1:
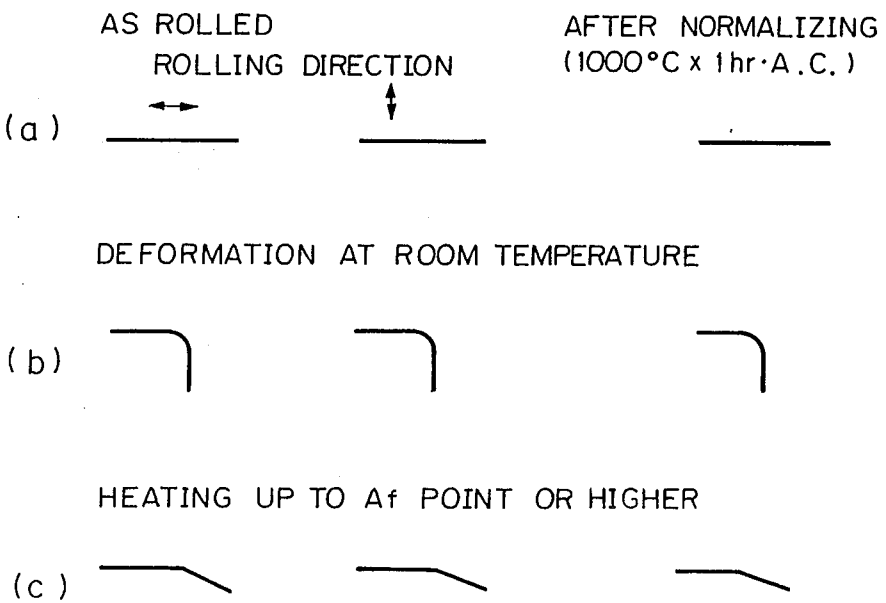
FIG. 1 illustrates the shape memory characteristic of the alloy according to the present invention.

The composition of the alloy according to the present invention is now described.

Mn is an austenite-stabilizing element and introduces the $\epsilon$ phase into the Fe-Mn alloy in concentrations exceeding 10%. When the Mn content is 20% or less, however, in addition to the $\gamma \rightleftarrows \epsilon$ transformation, $\alpha'$ martensite is introduced, detracting from the shape memory effect. At an Mn content exceeding 40%, the Neel point becomes too high for a satisfactory shape memory effect, so high that not even the addition of Si can lower it sufficiently.

Si, as described above, lowers the Neel point in contents of 3.5% or more. An Si content exceeding 8%, however, impairs the workability and formability of the alloy.

The present inventors also propose a shape memory alloy characterized by consisting of, in addition to from 20% to 40% of Mn and from 3.5% to 8% Si, not more than 10% of at least one element selected from the group consisting of Cr, Ni, and Co, not more than 2% of Mo, and/or not more than 1% of at least one element selected from the group consisting of C, Al, and Cu, the balance being Fe and unavoidable impurities. This alloy contains various alloying elements added to the above described Fe-Mn-Si alloy and features a further improved shape memory effect as well as improved corrosion resistance, heat resistance, and toughness. The discoveries made by and knowledges conceived by the present inventors until provisions of this alloy are described.

When the Fe-Mn-Si alloy is caused to transform by working or deforming it at a temperature, e.g., room temperature, lower than the Md temperature, where the martensite forms by the working, the mother phase transforms into $\epsilon$ martensite. Subsequently, upon heating above the Af temperature, where the inverse transformation is completed, the $\epsilon$ martensite transforms into the original $\gamma$ phase and the shape memory effect appears. Desirably, the martenste formed by deformation is exclusively the $\epsilon$ phase, but slip deformation of the mother $\gamma$ phase concurrently occurs. The slip deformation of the $\gamma$ phase results in a strain which is not capable of restoration by heating and appears to be a factor preventing 100% shape restoration. In addition, the corrosion resistance, heat-resistance, and toughness of the Fe-Mn-Si alloy are to be improved for practical utilization.

In order to further improve the shape memory effect of the Fe-Mn-Si based alloy, the stress at which the $\gamma$-$\epsilon$ transformation occurs should be low relative to the stress at which the slip deformation of the $\gamma$ phase occurs. The $\gamma$ and $\epsilon$ phases both have the closest packing structure. They differ structurally from one another in stacking. It is therefore believed that the $\gamma$-$\epsilon$ transformation tends to occur by lowering the stacking fault energy. The stacking fault energy is greatly influenced by alloying additive elements. As is known, the stacking fault energy of $\gamma$ Fe-alloys is decreased by adding Cr, Mo, Co and C. The present inventors added one or more of these elements into the Fe-Mn-Si based alloy and discovered a further improvement of the shape memory effect. The present inventors also learned that a small amount of Cu improves the corrosion resistance without impairing the shape memory effect and further Ni improves the toughness without impairing the shape memory effect.

The additive alloying elements contained in the alloy of the present invention are now described.

Cr facilitates the $\gamma\epsilon$ transformation and enhances the shape memory characteristic. Cr is also useful for improving the corrosion resistance. Cr in a content exceeding 10%, however, forms with Sr an intermetallic compound having a low melting point, so that melting of the alloy becomes difficult.

Ni improves the toughness without impairing the shape memory characteristic. An Ni content exceeding 10%, however, impairs the hot-workability.

Co improves the shape memory characteristic and hot-workability. A Co content exceeding 10% is meaningless as no outstanding advantages commensurate with such a larger content are obtained.

Mo improves the shape memory characteristic and heat-resistance. An Mo content exceeding 2%, however, impairs the how-workability and rather impairs the shape memory characteristic.

C enhances the shape memory characteristic. A C content exceedrng 1%, however, greatly impairs the toughness.

Al acts as a deoxidizing agent and improves the shape memory effect. Its effect saturates at an Al content of 1%.

Cu improves the corrosion resistance without impairing the shape memory characteristic at a C content up to 1%.

A method for producing the alloy according to the present invention is now described.

The raw materials are charged into a converter, an electric furnace, a high-frequency induction furnace or any other steelmaking furnace for melting. After adjusting the composition, the obtained melt is successively subjected to casting, rolling or any other shaping step to obtain the objective shape. The alloy according to the present invention exhibits an improved shape memory characteristic under the as-rolled state and does not vary even when the alloy according to the present invention is normalized (c.f. FIG. 1). FIG. 1 shows the shape of sheet material. The shape (b) is memorized.

Figure 2:
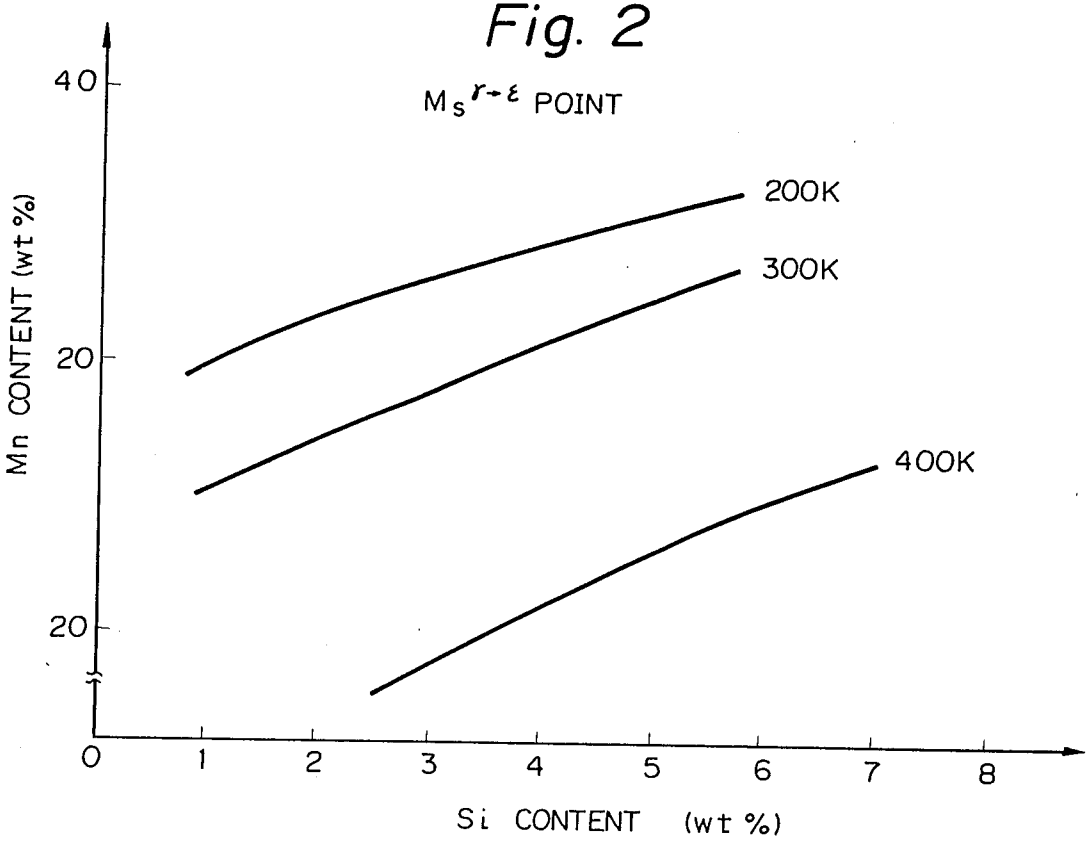
FIG. 2 is a graph showing the relationship between Ms points and alloying contents (Mn and Si)of the alloy according to the present invention.
Figure 3:
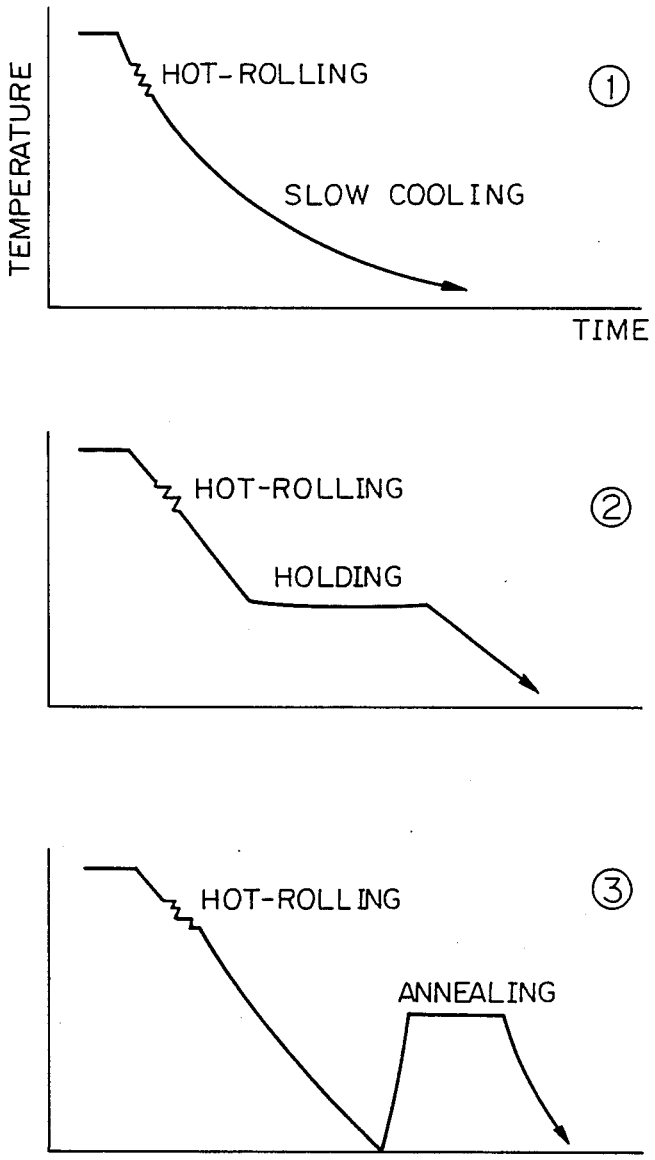
FIG. 3 illustrates the production steps according to the present invention.

When the Mn and Si contents are appropriately adjusted in the claimed range, the transformation temperatures, such as the $Ms^{\gamma\rightarrow\epsilon}$ point, $Md^{\gamma\rightarrow\epsilon}$ point, and $As^{\epsilon\rightarrow\gamma}$ point, can be easily controlled. The $Ms^{\epsilon\rightarrow\gamma}$ point ranges from less than −196° C. to 150° C., the $Md^{\gamma\rightarrow\epsilon}$ point from −50° C. to 250° C., and the $As^{\epsilon\rightarrow\gamma}$ point from 50 to 350° C., according to the Mn and Si contents. As shown by FIG. 2, by controlling the Mn and Si contents, especially the content of Si, which is the ferrite-former, deformation in the vicinity of room temperature followed by heating upto a relatively low As point or higher enables excellent restoration to the memorized shape.

The field of application of the alloy according to the present invention can be broadened by providing it in the form of thin sheet or a wire. The thickness of the sheet and the diameter of the wire are restricted by the cold-workability, which is inferior to hot-workability. The Fe-Mn-Si alloy known from the "Summary of General Lecture in Autumn Congress of Japan Institute for Metal," October, 1984, page 550, is difficult to work in that, upon working the alloy at room temperature, cracking occurs at a certain amount of working or more, so working heavier than this amount becomes difficult. This appears to be due to the fact that working the $\epsilon$ phase is introduced together with dislocations into the mother phase.

The present inventors considered that the $\epsilon$-phase formation due to working at room temperature is attributable to the higher Md point (the occurrence temperature of the deformation-induced $\gamma$-$\epsilon$ transformation) than the room temperature; and, hence, an easy working without incurrence of cracks can be attained by working the alloy at a temperature higher than the Md point. This consideration was affirmed by the present inventors themselves who heated the Fe-Mn-Si alloy to a temperature higher than the Md point and then worked it by rolling and wire-drawing. The obtained thin sheets and wires had good surface characteristics. The shape memory effect of the products at the worked (as rolled or as wire-drawn) state deteriorated, but it could again be restored to an excellent conditions by heating the products to a temperature of 400° C. or more and holding at this temperature for a predetermined time.

Based on the considerations and results described above, the present inventors also propose a method for working the shape memory alloy, wherein the hot-rolled Fe-Mn-Si alioy mentioned above, which may additionally contain 10% or less of at least one element selected from the group consisting of Cr, Ni, and Co, not more than 2% of Mo, and/or not more than 1% of at least one member selected trom the group consisting of C, Al, and Cu, characterized in that the alloy is worked at a temperature of the Md point or higher to suppress formation of the $\epsilon$ phase and to facilitate production of a sheet or a wire, and is, subsequently annealed at a temperature of the Af point or higher to restore the shape memory ability. The working carried out after hot-rolling may be the warm-rolling or the warm wire-drawing. During this working, the formation of $\epsilon$ phase is suppressed because of the reasons described above. The annealing time at the temperature of the Af point (finishing temperature of the $\epsilon \rightarrow \gamma$ transformation) may be, for example, 5 minutes or more. During this annealing, the shape memory characteristics, which may be impaired due to the working at the temperature of the Md point or higher, are restored.

The present inventors also provide a method for attaining virtually 100% of the shape memory effect for the Fe-Mn-Sr alloy. Discoveries and knowledge, which the present inventors obtained before the provision of this method, are now described. In an Fe-Mn-Si based shape memory alloy, the $\gamma \rightarrow \epsilon$ transformation is induced by deformation. Heating of the $\epsilon$ phase material to a temperature higher than the finishing temperature of the $\epsilon \rightarrow \gamma$ transformation is conducted, thereby realizing the $\gamma \rightarrow \epsilon \rightarrow \gamma$ cycle which generates the shape memory effect. The $\epsilon$ phases of the $\epsilon$martensite, which are induced by stress and which have a particular orientation, contribute to generating the shape memory effect. In this regard, if the $Ms^{\gamma \rightarrow \epsilon}$ point is hiqher than room temperature, $\epsilon$ phases are already formed prior to deformation. They are not deformation induced. Such $\epsilon$ phases do not necessarily revert to the state of the original mother phase after the inverse $\epsilon \rightarrow \gamma$ transformation, since which $\epsilon$ phases are not formed by deformation. The $\epsilon$ phases formed prior to deformation are therefore detrimental to the shape memory effect. The Ms point of the alloy according to the present invention can be lowered to a temperature less than room temperature by means of adjusting the Mn and Si contents as well as the content of additive alloying elements such as Cr and Mo. Thus, the alloy according to the present invention can have an Ms point lower than room temperature. Such an alloy which also can have an excellent shape memory effect of approximately 75%, contains appreciable amount of $\epsilon$-martensite mixed in with the $\gamma$ phase at a room temperature higher than the Ms point. This appears to be because an alloy having an excellent shape memory effect is susceptible to $\gamma \rightarrow \epsilon$ transformation deformation on cooling. The $\epsilon$ phase mixes in even due to thermal stress at the Md point or lower. The $\epsilon$ phase formed in the course of cooling appears to be detrimental to the shape memory effect, which therefore, can be enhanced by lessening the quantity of the phase. As is well known, martensite formation is largely dependent upon not only the alloy composition but also the alloy structure and the grain size as well as the cooling speed. Accordingly, the present inventors considered that, in also the alloy to which the present invention pertains, mixing of $\epsilon$ mertensite formed during cooling can be prevented to so extent by means of appropriately controlling the heat treatment and cooling. The present inventors performed experiments with varying heat treatment and cooling conditions and discovered the method for lessening the quantity of $\epsilon$ phase at room temperature. This method is characterized, for a 26–34% Mn and 4–7% Si composition, by: (1) cooling, after hot-rolling, at a rate of 20° C./minute or less; (2) during cooling after hot-rolling, holding at a temperature of the Md point or higher and 800° C. or lower for a time period of 5 minutes or longer and further cooling; or, (3) subsequent to the cooling after hot-rolling, reheating to a temperature of the Af point or higher and 800° C. or lower and, after annealing to this temperature, cooling down to room temperature. Any one of these three cooling or heat treating methods further improves the shape memory characteristics.

The above described Fe-Mn-Si alloy is Fe-based or its major component is Fe. Its production cost is therefore extremely inexpensive compared with Ti-Ni alloys and Cu-base alloys. The strength and toughness of the Fe-Mn-Si alloy are excellent. These properties plus the lower production cost open up wider fields of applications for shape memory alloys as compared with the conventional Ti-Ni and Cu alloys. The Fe-Mn-Si based alloy with an alloying additive of Cr, Ni, Co, C, Al, and/or Cu has an improved shape memory characteristics, corrosion resistance, and hot-workability.

The present invention is explained with reference to the examples.

Example 1

Alloys having the compositions as shown in Table 1 were melted by using a high-frequency, induction-heated, air-melting furnace and a vacuum-melting furnace. The alloys were cast into ingots. All of the ingots were held at a temperature of from 1250° C. to 1050° C. for 1 hour and then rolled into sheets 13 mm in width. The sheets were cut into sheet specimens 0.5 mm×1.5 mm×20 mm in size. Bending deformation by 90° was imparted to them at room temperature. Subsequently, the bent sheet specimens were heated to above the As point. The shape memory effect was measured based on the shape recovered after heating and is given in Table 1.

In order to evaluate the hot-workability, hotrolling was carried out after heating at 1200° C. for 1 hour. The rolled slabs 13 mm in thickness were evalutated based on three criteria of the surface characteristics: no problem at all (0); slight defects (Δ); and cracks and the like (x).

As apparent from Table 1, the alloys according to the present invention are excellent in both the shape memory effect (SME) and hot-workability.

TABLE 1

| | Components | | | | |
|---|---|---|---|---|---|
| | Mn | Si | Fe | SME | Formability |
| Invention | 20 | 3.5 | bal | O | O |

TABLE 1-continued

| | Components | | | | |
|---|---|---|---|---|---|
| | Mn | Si | Fe | SME | Formability |
| | 32 | 6 | bal | ◎ | ○ |
| | 40 | 8 | bal | ○ | Δ |
| Comparative | 21.4 | 1.8 | bal | x | ○ |
| | 35.6 | 3.1 | bal | x | ○ |
| | 27.3 | 0.9 | bal | x | ○ |
| | 40 | 10 | bal | — | x |
| | 30 | — | bal | x | ○ |
| | 20 | 1.6 | bal | x | ○ |
| | 20 | 11 | bal | — | x |

SME (Shape Memory Effect)
◎ >75%
○ 25~75%
x <25%

Example 2

Alloys having the compositions as shown were melted by using a high-frequency, induction-heated, air-melting furnace. The alloys were cast into ingots. All of the ingots were held at a temperature of the from 1250° C. to 1050° C. for 1 hour and then rolled into sheets 13 mm in width. The sheets were cut into sheet specimens 0.5 mm×1.5 mm×20 mm in size. Bending deformation by 45° was imparted to them at room temperature. Subsequently, the bent sheet specimens were heated to above the Af point. The shape memory effect was measured based on the shape recovered after heating and is given in Table 2. The hot-workability was evaluated in the same manner as in Example 1. For the test of corrosion resistance, specimens 2 mm×100 mm×100 mm in size were prepared and were exposed to the atmosphere for one year. The corrosion resistance is expressed by the symbols of Δ, ○ and ◎ for the relative corrosion amounts of 50–150, 20–50, and 20 or less with the premise that the corrosion amount of Fe-30%Mn-6%Si is 100.

As apparent from Table 2, the alloys according to the present invention are excellent in both the shape memory effect (SME) and hot-workability. Excellent corrosion resistance can be imparted to the alloy of present invention, if necessary.

TABLE 2

| | Components | | | | | | | | | | | | Corrosion |
|---|---|---|---|---|---|---|---|---|---|---|---|---|---|
| | Mn | Si | Cr | Ni | Co | Al | C | Cu | Mo | Fe | Shape Recovery | Formability | Resistance |
| Invention | 30 | 6.0 | 5.0 | — | — | — | — | — | — | Bal | 0.90 | ○ | ○ |
| | 25 | 6.0 | — | 5.0 | — | — | — | — | — | " | 0.76 | Δ | Δ |
| | 30 | 5.5 | — | — | 10.0 | — | — | — | — | " | 0.80 | ○ | Δ |
| | 30 | 6.0 | — | — | — | — | — | — | 1.0 | " | 0.80 | ○ | ○ |
| | 30 | 5.0 | — | — | — | 0.5 | — | — | — | " | 0.78 | ○ | Δ |
| | 28 | 5.5 | — | — | — | — | 0.1 | — | — | " | 0.80 | ○ | Δ |
| | 30 | 6.0 | — | — | — | — | — | 0.4 | — | " | 0.76 | ○ | ○ |
| | 30 | 5.5 | 5.0 | 0.3 | — | 0.02 | 0.05 | 0.3 | — | " | 0.85 | ○ | ◎ |
| | 32 | 5.5 | 5.0 | — | — | — | 0.07 | 0.4 | 1.0 | " | 0.80 | ○ | ◎ |
| Comparative | 20 | 4.0 | 15.0 | — | — | — | — | — | — | " | — | x | — |
| | 20 | 4.5 | — | 12.0 | — | — | — | — | — | " | — | x | — |
| | 32 | 5.5 | — | — | — | — | 1.5 | — | — | " | — | x | — |
| | 25 | 4.0 | — | — | — | — | — | — | 2.5 | " | — | x | — |
| | 32 | 5.5 | — | — | — | 1.0 | — | — | — | " | 0.75 | ○ | Δ |
| | 28 | 5.0 | — | — | — | — | 1.1 | — | — | " | 0.30 | Δ | Δ |
| | 30 | 6.0 | — | — | — | — | — | — | — | " | 0.75 | ○ | Δ |

Example 3

Table 3 shows the composition, the rolling temperature, the annealing temperature, the shape memory effect, and the surface properties of still other specimens. The production and testing method in the present example are the same as in Example 1 except that the rolled sheets were then annealed and the specimens were 0.4 mm×2 mm×30 mm in size and were heated to 400° C. after bending.

As is apparent from Table 3, the alloys according to the present invention are excellent in both the shape memory effect (SME) and the surface property.

TABLE 3

| | Components | | | | | | | | | | | | | |
|---|---|---|---|---|---|---|---|---|---|---|---|---|---|---|
| | Mn | Si | Cr | Ni | Co | Al | Cu | Mo | C | Fe | Md point | Rolling Temperature | Surface Characteristic | Annealing Temperature | Shape Recovery |
| Invention | 30 | 6.0 | — | — | — | — | — | — | — | Bal | 150° C. | 400° C. | ○ | 800° C. | 0.75 |
| | 30 | 5.5 | 5.0 | — | — | — | — | — | — | " | 125° C. | 350° C. | ○ | 1000° C. | 0.80 |
| | 30 | 5.5 | 5.0 | 0.2 | 2.0 | 0.02 | 0.2 | 1.0 | 0.05 | " | 130° C. | 500° C. | ○ | 1000° C. | 0.78 |
| | 28 | 6.5 | 2.0 | 1.0 | — | — | — | — | — | " | 175° C. | 400° C. | ○ | 700° C. | 0.70 |
| | 25 | 7.0 | — | — | — | 0.5 | 0.4 | — | — | " | 200° C. | 250° C. | ○ | 900° C. | 0.68 |
| | 29 | 4.0 | 5.0 | — | — | — | — | 1.0 | — | " | 175° C. | 300° C. | ○ | 500° C. | 0.68 |
| Comparative | | 30 | 6.0 | — | — | — | — | — | — | — | — | 100° C. | x | — | — |
| | 30 | 6.0 | 5.0 | — | — | — | — | — | — | " | — | 20° C. | x | — | — |
| | 28 | 6.5 | 2.0 | 1.0 | — | — | — | — | — | " | — | 500° C. | ○ | — | 0.20 |
| | 30 | 5.5 | 5.0 | 0.2 | 2.0 | 0.02 | 0.2 | 1.0 | 0.05 | " | — | 500° C. | ○ | — | 0.16 |
| | 25 | 7.0 | — | — | — | 0.5 | 0.4 | — | — | " | — | 20° C. | x | — | — |
| | 29 | 4.0 | 5.0 | — | — | — | — | 1.0 | — | " | — | 150° C. | x | — | — |
| | 30 | 6.0 | 5.0 | — | — | — | — | — | — | " | — | 350° C. | ○ | — | 0.30 |

Example 4

Table 4 shows the composition, the production method, the quantity of ϵ phase, and the shape memory effect of still further specimens. The testing method in the present example is the same as in Example 3. The ϵ phase was quantitatively analyzed by the X-ray diffraction method.

As is apparent from Table 4, the shape memory effect is improved with a decrease in the quantity of ϵ phase.

TABLE 4

| Components | | | | | | | | | | | | | |
|---|---|---|---|---|---|---|---|---|---|---|---|---|---|
| Mn | Si | Cr | Ni | Co | Al | Cu | Mo | C | Ms point | Af point | Producton Method | ε (%) | Shape Recovery |
| | | | | | | | | | Invention | | | | |
| 30 | 6.0 | — | — | — | — | — | — | 8.0 | 40° C. | 175° C. | Hot-rolling, reheating and then annealing at 400° C. × 10 minutes | 3.2 | 0.90 |
| 30 | 5.5 | 6.2 | — | — | 0.015 | — | 0.5 | 0.015 | 15° C. | 125° C. | Hot-rolling, reheating and then annealing at 400° C. × 10 minutes | 0.5 | 0.98 |
| 30 | 5.5 | 5.0 | 0.2 | 2.0 | 0.02 | 0.2 | 1.0 | 0.02 | 20° C. | 200° C. | Hot-rolling, reheating and then annealing at 400° C. × 10 minutes | 2.0 | 0.92 |
| 28 | 6.5 | 2.0 | 1.0 | — | — | 0.15 | — | 0.01 | 50° C. | 270° C. | Hot-rolling, reheating and then annealing at 400° C. × 10 minutes | 4.0 | 0.88 |
| 26 | 4.0 | — | — | 10.0 | 0.015 | — | 0.3 | 0.1 | 60° C. | 400° C. | Hot-rolling, reheating and then annealing at 400° C. × 10 minutes | 1.9 | 0.85 |
| 34 | 7.0 | — | 5.0 | — | — | 0.2 | — | — | 40° C. | 350° C. | Hot-rolling, reheating and then annealing at 400° C. × 10 minutes | 4.5 | 0.94 |
| 34 | 4.0 | 5.2 | 9.5 | — | — | 1.0 | — | — | 10° C. | 200° C. | Hot-rolling, reheating and then annealing at 400° C. × 10 minutes | 3.8 | 0.92 |
| 26 | 5.0 | — | — | — | 0.8 | — | 2.0 | — | 60° C. | 410° C. | Hot-rolling, reheating and then annealing at 400° C. × 10 minutes | 2.3 | 0.95 |
| 32 | 5.0 | 8.5 | — | — | — | 0.10 | — | — | −10° C. | 250° C. | Hot-rolling, reheating and then annealing at 400° C. × 10 minutes | 2.1 | 0.98 |
| 32 | 5.0 | — | — | — | 0.02 | — | — | 0.5 | 0° C. | 150° C. | Hot-rolling followed by cooling at 20° C./minute | 4.3 | 0.80 |
| 32 | 5.0 | — | — | 5.0 | — | — | 0.5 | — | −5° C. | 160° C. | Hot-rolling, reheating and then annealing at 550° C. × 5 minutes | 3.2 | 0.87 |
| 32 | 5.0 | 3.2 | — | — | 0.01 | 0.01 | — | 0.01 | −10° C. | 175° C. | Hot-rolling and holding at 200° C. for 5 minutes during a subsequent cooling | 6.0 | 0.85 |
| | | | | | | | | | Comparative | | | | |
| 32 | 5.0 | — | — | — | — | — | — | — | 5° C. | 160° C. | As ordinarily rolled | 9.3 | 0.76 |
| 30 | 6.0 | — | — | — | — | — | — | 1.0 | 20° C. | 200° C. | As ordinarily rolled | 8.0 | 0.75 |
| 30 | 5.5 | 5.0 | — | — | — | — | — | — | 10° C. | 125° C. | As ordinarily rolled | 2.0 | 0.90 |
| 30 | 5.5 | 5.0 | 0.2 | 2.0 | 0.02 | 0.2 | 1.0 | 0.05 | 15° C. | 140° C. | As ordinarily rolled | 4.0 | 0.85 |
| 28 | 6.5 | 2.0 | 1.0 | — | — | — | — | — | 40° C. | 250° C. | As ordinarily rolled | 8.8 | 0.80 |
| 26 | 4.0 | — | — | 10.0 | — | — | — | — | 100° C. | 400° C. | As ordinarily rolled | 5.6 | 0.66 |
| 34 | 7.0 | — | 5.0 | — | — | — | — | — | 30° C. | 230° C. | As ordinarily rolled | 10.7 | 0.77 |
| 34 | 4.0 | 5.0 | 10.0 | — | — | 1.0 | — | — | −35° C. | 125° C. | As ordinarily rolled | 9.4 | 0.80 |
| 26 | 5.0 | — | — | — | 1.0 | — | 2.0 | — | 60° C. | 300° C. | As ordinarily rolled | 8.8 | 0.84 |
| 32 | 5.0 | 10.0 | — | — | — | — | — | — | −10° C. | 115° C. | As ordinarily rolled | 4.8 | 0.77 |

We claim:

1. A polycrystalline alloy article which consists, by weight percentage of from 20% to 40% of Mn, from 3.5% to 8% of Si, and the balance Fe and unavoidable impurities which is essentially comprised of a ε phase at room temperature prior to plastic working, in which an γ phase is formed by plastic working at an Md temperature point (point of martensitic transformation by plastic working) or lower temperature, and which memorizes a shape thereof prior to said plastic working upon heating to an As point (the ε→γ transformation starting point) or higher temperature.

2. A polycrystalline alloy article according to claim 1, wherein a predetermined shape thereof is imparted by hot-rolling and the alloy article prior to said plastic working is not less than 85% of the γ phase and not more than 15% of the ε phase at room temperature.

3. A polycrystalline alloy article according to claim 2, wherein the shape is predetermined by subjecting the alloy to warm working at a temperature of the Md point or higher temperature.

4. A polycrystalline alloy article according to claim 1, produced by hot-rolling, warm-working at said Md point or higher temperature, and subsequently annealing at a temperature equal to or higher than an austenite-transformation finishing temperature (Af).

5. A polycrystalline alloy article according to claim 4, wherein the Mn content is from 26% to 34% and the Si content is from 4% to 7%, and, further, subsequent to the hot-rolling cooling at a rate of 20° C./minute or less.

6. A polycrystalline alloy article according to claim 4, wherein the Mn content is from 26% to 34% and the Si content is from 4% to 7%, and, further, subsequent to the hot-rolling, holding, in the course of cooling, at a temperature range not lower than an Ms point and not higher than 800° C. for a time period of 5 minutes or longer, and then further cooling.

7. A polycrystalline alloy article according to claim 4, wherein the Mn content is from 26% to 34% and the Si content is from 4% to 7%, and, further subsequence to the hot-rolling and cooling, reheating to a temperature range not lower than the Af point and hot higher than 800° C. and annealing in said temperature range, followed by cooling.

8. A polycrystalline alloy article which consists, by weight percentage, of from 20% to 40% of Mn; from 3.5% to 8% of Si; at least one alloying element selected from the group consisting of (a), (b), and (c); (a) not more than 10% each of at least one element selected from the group consisting of Cr, Ni, and Co; (b) not more than 2% of Mo; and (c) not more than 1% each of at least one element selected from the group consisting of C, Al, and Cu; and the balance Fe and unavoidable impurities which is essentially comprised of γ phase at room temperature prior to plastic working, in which an ε phase is formed by plastic working at an Md temperature point (point of martensitic transformation by plastic working) or lower temperature, and which memorizes a shape thereof prior to said plastic working upon heating to an As point (the ε→γ transformation starting point) or higher temperature.

9. A polycrystalline alloy article according to claim 8, wherein a predetermined shape thereof is imparted by hot-rolling and the alloy particle prior to said plastic working is not less than 85% of the γ phase and not more than 15% of the ε phase at room temperature.

10. A polycrystalline alloy article according to claim 9, wherein the shape is predetermined by further subjecting the alloy to warm working at a temperature of the Md point or higher temperature.

11. A polycrystalline alloy article according to claim 8, produced by hot-rolling warm-working at said Md point or higher temperature, and subsequently annealing at a temperature equal to or higher than austenite-transformation finishing temperature (Af).

12. An polycrystalline alloy article according to claim 11, wherein the Mn content is from 26% to 34% and the Si content is from 4% to 7%, and, further subsequent to the hot-rolling, cooling at a rate of 20° C./minute or less.

13. An polycrystalline alloy article according to claim 11, wherein the Mn content is form 26% to 34% and the Si content is from 4% to 7%, and, further, subsequent to the hot-rolling, holding, in the course of cooling, at a temperature range not lower than an Ms point and not higher than 800° C. for a time period of 5 minutes or longer, and then further cooling.

14. An polycrystalline alloy article according to claim 11, wherein the Mn content is from 26% to 34% and the Si content is from 4% to 7%, and, further, subsequent to the hot-rolling and cooling, reheating to a temperature range not lower than the Af point and not higher than 800° C. and annealing in said temperature range, followed by cooling.

15. A method for producing a shape memory polycrystalline alloy article, comprising the steps of:

obtaining an alloy consisting of from 20% to 40% of Mn, from 3.5% to 8% of Si, and the balance Fe and unavoidable impurities, hot-rolling said alloy article to obtain a predetermined shape.

16. A method according to claim 15, further comprising the steps of:

subsequent to said hot-rolling warm-rolling or wire drawing at a temperature range not lower than an Md point (point of martensitic transformation by plastic working) and annealing at a temperature of an Af point (an austenite transformation finishing temperature) or higher temperature.

17. A method according to claim 15, wherein the Mn content is from 26% to 34% and the Si content is from 4% to 7%, further comprising a step of cooling, subsequent to said hot-rolling, at a rate of 20° C./minute or less.

18. A method according to claim 15, wherein the Mn content is from 26% to 34% and the Si content is from 4% to 7%, further comprising the steps of:

cooling subsequent to said hot-rolling;

holding, in the course of said cooling, at a temperature range not lower than the Ms point and not higher than 800° C. for a period of 5 minutes or longer; and subsequently cooling to room temperature.

19. A method according to claim 15, wherein the Mn content is from 26% to 34% and the Si content is from 4% to 7%, further comprising the steps of:

subsequent to said hot-rolling, cooling;

reheating to a temperature range not lower than an Af point and not higher than 800° C.; and annealing in said temperature range, followed by cooling.

20. A method for producing a shape memory polycrystalline alloy article, comprising the steps of:

obtaining a polycrystalline alloy article consisting of from 20% to 40% or Mn; from 3.5% to 8% of Si; at least one alloying element selected from the group consisting of (a), (b), and (c): (a) not more than 10% each of at least one element selected from the group consisting of Cr, Ni, and Co; (b) not more than 2% of Mo; and (c) not more than 1% each of at least one element selected from the group consisting of C, Al, and Cu; and the balance Fe and unavoidable impurities, and hot-rollrng said alloy article to obtain a predetermined shape.

21. A method according to claim 20, further comprising the steps of:

subsequent to said hot-rolling, warmrolling or wire-drawing at a temperature range not lower than the Md point (point of martensitic transformation by plastic working) and annealing at a temperature of an Af point (an austenite transformation finishing temperature) or higher.

22. A method according to claim 20, wherein the Mn content is from 26% to 34% and the Si content is from 4% to 7%, further comprising a step of cooling, subsequent to said hot-rolling, at a rate of 20° C./minute or less.

23. A method according to claim 20, wherein the Mn contents from 26% to 34% and the Si content is from 4% to 7%, further comprising the steps of:

cooling subsequent to said hot-rolling;

holding, in the course of said cooling, at temperature range not lower than the Ms point and not higher than 800° C. for a period of 5 minutes or longer; and subsequently cooling to room temperature.

24. A method according to claim 20, wherein the Mn content is from 26% to 34% and the Si content is from 4% to 7%, further comprising the steps of:

subsequent to said hot-rolling cooling;

reheating to a temperature range not lower than an Af point and not higher than 800° C.; and annealing in said temperature range, followed by cooling.

25. A polycrystalline alloy article consisting essentially of from 20% to 40% of Mn, from 3.5% to 8% of Si, and the balance Fe and unavoidable impurities, said article having a memorized predetermined shape and having been produced by the process comprising:

providing said alloy article in said predetermined shape at room temperature and essentially comprised of γ phase;

plastically deforming said alloy article at an Md temperature point or lower temperature thereby transforming said γ phase to ε phase;

heating said plastically deformed alloy article to an As temperature point or higher temperature thereby transforming said ε phase to γ phase wherein said deformed alloy article returns to said predetermined shape as a result of said heating.

26. A method of providing a shape memory polycrystalline alloy article comprising:

providing at room temperature a polycrystalline alloy article consisting essentially of from 20% to 40% of Mn, from 3.5% to 8% of Si, the balance Fe and unavoidable impurities, with said allow article having a predetermined shape and essentially comprised of γ phase;

plastically deforming said alloy article at an Md temperature point or lower temperature thereby transforming said $\gamma$ phase to $\epsilon$ phase;

heating said plastically deformed alloy article to an As temperature point or higher temperature thereby transforming said $\epsilon$ phase to $\gamma$ phase whereby said deformed alloy article returns to said predetermined shape as a result of said heating.

* * * * *

UNITED STATES PATENT AND TRADEMARK OFFICE

CERTIFICATE OF CORRECTION

PATENT NO. : 4,780,154

DATED : October 25, 1988

INVENTOR(S) : T. Mori, et al.

It is certified that error appears in the above-identified patent and that said Letters Patent is hereby corrected as shown below:

Column 1, line 14, change "rs" to --is--.

Column 1, line 40, change "economicalness" to --economy--.

Column 1, line 43, change "economicalness" to --economy--.

Column 1, line 57, change "economicalness" to --economy--.

Column 1, line 46, change "Tr" to --Ti--.

Column 2, line 18, change "efteot" to --effect--.

Column 3, line 63, change "ye" to --y-e--.

Column 4, line 13, change "exceedrng" to --exceeding--.

Column 5, line 7, change "conditions" to --condition--.

Column 5, line 36, change "Fe-Mn-Sr" to --Fe-Mn-Si--.

UNITED STATES PATENT AND TRADEMARK OFFICE

CERTIFICATE OF CORRECTION

PATENT NO. : 4,780,154

DATED : October 25, 1988

INVENTOR(S) : T. Mori, et al.

It is certified that error appears in the above-identified patent and that said Letters Patent is hereby corrected as shown below:

Column 5, line 47, change "hiqher" to --higher--.

Column 6, line 36, omit "an" between "has" and "improved".

Column 6, line 55, change "hotrolling" to --hot-rolling--.

Column 7, line 37, between "shown" and "were" insert --in Table 2--.

Column 7, line 40, change "temperature of the from" to --temperature of from--.

Column 9, line 40, change "E" to --y--.

Column 9, line 42, change "y" to --E--.

Column 9, line 54, between "by" and "subjecting" insert --further--.

Column 10, line 44, change "subsequence" to --subsequent--.

UNITED STATES PATENT AND TRADEMARK OFFICE

CERTIFICATE OF CORRECTION

PATENT NO. : 4,780,154

DATED : October 25, 1989

INVENTOR(S) : T. Mori, et al.

It is certified that error appears in the above-identified patent and that said Letters Patent is hereby corrected as shown below:

Column 10, line 46, change "hot" to --not--.

Column 11, lines 12, 17 and 24, change "An" to --A--.

Column 11, line 33, change "an alloy" to --a polycrystalline alloy article--.

Column 12, line 13, change "hot-rollrng" to --hot-rolling--.

Column 12, line 17, change "warmrolling" to --warm-rolling--.

Column 12, line 29, change "contents from 26%" to --content is from 26%--.

Signed and Sealed this

Twenty-third Day of May, 1989

*Attest:*

*Attesting Officer*

DONALD J. QUIGG

*Commissioner of Patents and Trademarks*